US006925822B2

(12) United States Patent
Lifson et al.

(10) Patent No.: US 6,925,822 B2
(45) Date of Patent: Aug. 9, 2005

(54) OIL RETURN CONTROL IN REFRIGERANT SYSTEM

(75) Inventors: Alexander Lifson, Manlius, NY (US); Michael F. Taras, Fayetteville, NY (US); Thomas J. Dobmeier, Phoenix, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/732,501

(22) Filed: Dec. 10, 2003

(65) Prior Publication Data

US 2005/0126193 A1 Jun. 16, 2005

(51) Int. Cl.[7] ..... F25B 7/00; F25B 31/00

(52) U.S. Cl. ..... 62/175; 62/193; 62/196.1; 62/228.5; 62/510

(58) Field of Search ..... 62/84, 113, 175, 62/193, 196.1, 197, 228.5, 510, 513

(56) References Cited

U.S. PATENT DOCUMENTS

| | | | | |
|---|---|---|---|---|
| 4,876,859 | A | 10/1989 | Kitamoto | |
| 5,875,637 | A | 3/1999 | Paetow | |
| 6,047,556 | A | 4/2000 | Lifson | |
| 6,206,652 | B1 | 3/2001 | Caillat | |
| 6,804,971 | B2 * | 10/2004 | Lee | 62/175 |
| 6,860,116 | B2 * | 3/2005 | Lifson et al. | 62/498 |

OTHER PUBLICATIONS

Systems & Advanced Technologies Engineering S.r.I., publication entitled "Compsys—Dynamic Simulation of Gas Compression Plants", dated Jun. 12, 2002.

Copeland Europe publication entitled "Refrigeration Scroll for Parallel Applications" dated Feb. 26, 2002.

* cited by examiner

*Primary Examiner*—Marc Norman
(74) *Attorney, Agent, or Firm*—Carlson, Gaskey & Olds

(57) ABSTRACT

Several control algorithms reduce the likelihood of insufficient oil return to the compressor. One algorithm is useful in a multi-circuit refrigerant system. A control reduces the cooling capacity of one of the circuits if the number of compressor start/stop cycles becomes excessive. By reducing the capacity, the control will reduce the number of compressor start/stop cycles for a circuit. In this manner, the oil continues to circulate through the circuit, and is more efficiently returned to the compressor. Another problem area associated with a poor oil return back to the compressor is when there is low mass flow rate of refrigerant circulating through the system. Various ways of increasing the refrigerant mass flow rate are disclosed to ensure proper oil return to the compressor. Also, if oil return problems are likely due to an undesirably high oil viscosity at the vapor portion of the evaporator or suction line, then steps are taken to reduce oil viscosity. Overall, the present invention discloses three distinct algorithms that may be utilized, either separately or in combination, to ensure better flow of oil back to the compressor. The invention enhances system and compressor reliability and performance as well as prevents the compressor damage.

11 Claims, 1 Drawing Sheet

OIL RETURN CONTROL IN REFRIGERANT SYSTEM

BACKGROUND OF THE INVENTION

This invention relates to several methods of ensuring oil return from the various system components to the compressor under various operational conditions, and preventing oil pump out from the compressor causing subsequent compressor damage.

Refrigerant cycles are utilized to provide cooling or heating. A refrigerant is compressed by a compressor, and then moved through a series of heat exchangers, connection lines and expansion devices.

There are many distinct configurations and arrangements of refrigerant cycles. One of the options is the use of multi-circuit refrigerant systems. A multi-circuit system has at least two circuits, each including a compressor and the associated heat exchangers, connection lines and expansion devices for conditioning a common area. The circuits, each including a compressor, condenser, expansion device, and evaporator are controlled to maintain a desired temperature in an environment to be cooled or heated.

Multi-circuit systems are prone to oil pump out under conditions where the amount of cooling required is just above of what one circuit can deliver. In this case, the system must be shut off frequently to compensate for the excessive supply of cold air generated by two circuits operating at the same time. Frequent start-stops can cause oil to be pumped out from the compressor reducing system efficiency by logging excessive amounts of oil in heat exchangers and potentially leading to compressor failure.

Another condition that can exist in both multi-circuit and single circuit systems that can lead to oil pump out is a low mass flow through the evaporator. If the mass flow is reduced below a certain level, the vapor can no longer carry the oil back to the compressor, again leading to oil pump out. The problem can be further aggravated by excessive vapor superheat entering the compressor, as high superheat leads to boiling off refrigerant from oil, increasing oil viscosity and causing the oil to "stick" to heat exchanger inner tube surfaces. Thus, the need exists to improve oil return under the above-mentioned conditions.

A control unit for the multi-circuit system separately controls all circuits, or some of the circuits to provide cooling. In the prior art, the control unit intermittently will shut down all circuits once sufficient cooling had been achieved. Alternatively, in the prior art, the control unit will sometimes shut down just some circuits while keeping the other ones operating when less cooling demand is placed on the overall system.

The present invention is intended to address the above-referenced problems that were present in the prior art control schemes.

SUMMARY OF THE INVENTION

In a disclosed embodiment of this invention, algorithms to control the operation of refrigerant cycles are provided, and address the problem of oil pump out from the compressor. If the amount of cooling required is just above what can be met by one operational circuit, then two circuits become operational. However, with the two circuits running, the amount of cold air delivered is often too high for the demand. Thus, in the past, both circuits have been frequently cycled on/off. This leads to oil pump out as the oil is pumped out on the start up, but does not have sufficient time to return back to the compressor before the units start off again. In a first embodiment method, if both circuits are operating in economized mode and are frequently shut down, then the controller decides to operate one circuit in non-economized mode, if the shut downs are still too excessive, then both circuits run non-economized. If the shutdowns are still excessive, then the controller puts one circuit into bypass mode of operation and the remaining circuit is running non-economized. If there are still excessive shutdowns, both circuits are put into bypass mode (unloaded mode of operation). If the shutdowns are still excessive, then only one circuit is taken "off line" while the other circuit is continuing to operate. Then, intermittently, both circuits come on-line. The circuit that is running can be alternated from one circuit to the other circuit. Additionally, the decision can be made on the mode of operation in each of those two circuits. This technique can be extended to a system that has more than one circuit.

The subject of another embodiment is operation at low mass flow rate (as for example, heat pump operation). In this case, the oil pump out can occur because the refrigerant mass flow is too low to carry the oil inside the heat exchanger tubes. This becomes especially an issue when the system is run in unloaded mode (lowest mass flow) rate. The inventive solution is for the controller to intermittently run the system at the highest available mass flow by switching to a more loaded mode of operation or raising the mass flow through the evaporator section either by blocking the condenser coils or reducing fan speed.

The subject of yet another embodiment is oil pump out due to excessive superheat entering the compressor. This problem is most prominent in long lines leading from an evaporator exit to a compressor suction (vapor gains superheat between evaporator exit and compressor entrance). For this case, especially if coupled with low mass flow operation, the oil will be logged in this section of the pipe, as its viscosity increases rapidly as superheat is increased and refrigerant is boiled off from the oil. To prevent this occurrence, it is proposed to monitor the superheat and suction pressure (suction pressure and suction superheat uniquely define the mass flow). Then if the controller determines that the amount of superheat is excessive for a given mass flow, the expansion device, such as, for example, an electronic expansion device (EXV) opens up to decrease the superheat entering the compressor.

These and other features of the present invention can be best understood from the following specification and drawings, the following of which is a brief description.

DETAILED DESCRIPTION OF THE PREFERRED EMBODIMENT

Figure 1:
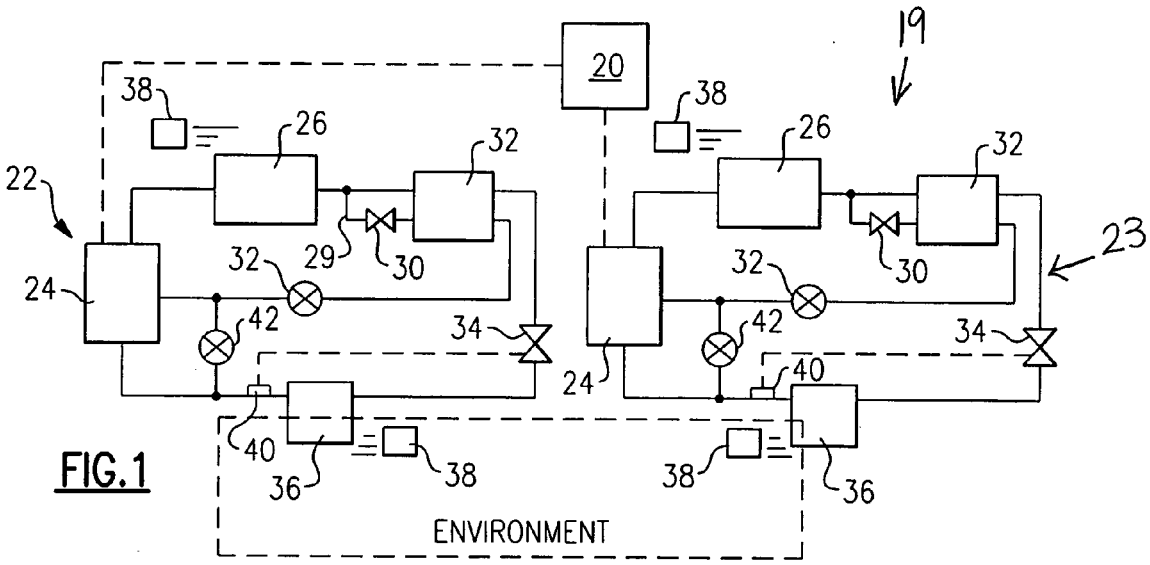
FIG. 1 is a schematic view of a circuit incorporating the present invention.
Figure 2:
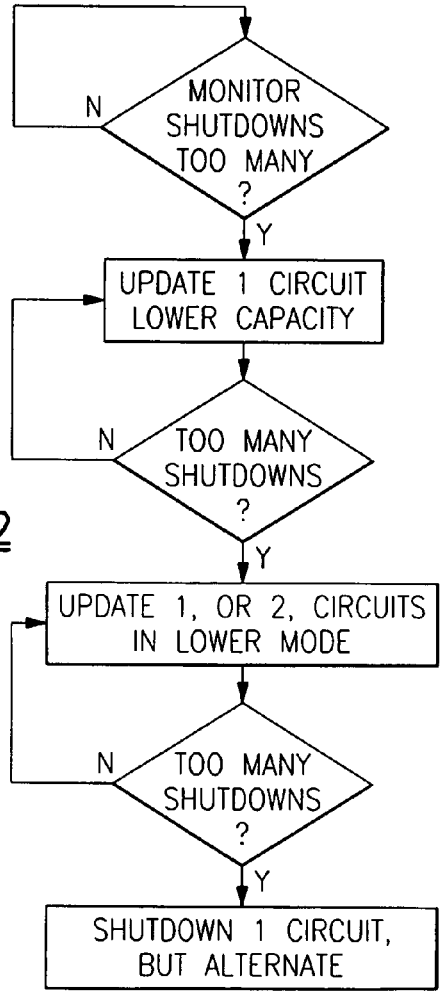
FIG. 2 is a flowchart of a first feature.

A refrigerant circuit 19 is illustrated schematically in FIG. 1 having a control unit 20 controlling a pair of separate circuits 22 and 23. Some aspects of this invention are particularly directed to such a multi-circuit system (in particularly the algorithm of FIG. 2). However, the FIG. 3 and FIG. 4 algorithm aspects may extend to refrigerant cycles having only a single circuit. While a two circuit system is shown, additional circuits may be used.

As shown in FIG. 1, each circuit 22 and 23 includes a compressor 24 delivering refrigerant to a condenser 26, which in turn delivers refrigerant to an economizer heat exchanger 28. A tap line 29 taps refrigerant from the line downstream of the condenser 26 through an economizer expansion device 30. While the flow through the tap 29 and the main flow from the condenser to the economizer heat exchanger 28 are shown moving in the same direction, most preferably, they are in a counter-flow relationship. However, for ease of illustration, they are shown here flowing in the same direction through the economizer heat exchanger 28. On the tap line 29, and downstream of the economizer heat exchanger 28 is an economizer shutoff valve 32. Downstream of the economizer heat exchanger 28 on the main refrigerant flow is an expansion device 34. Refrigerant moves through the expansion device 34 to an evaporator 36, and returns to a suction port of the compressor 24. An evaporator fan 38, and a condenser fan 38 respectively deliver air over the condenser 26 and evaporator 36. For the cooling cycle, the condenser 26 is outdoors while the evaporator 36 is indoors. A sensor 40 senses refrigerant conditions downstream of the evaporator 36 and may control the expansion device 34 accordingly, and under the control of control unit 20. An unloader valve 42 selectively connects the economizer return line to the suction line, as known. Of course, other unloader valve positions are known.

As shown, the two circuits 22 and 23 are positioned to jointly condition an environment. The load from the environment will change over time. In the prior art, the known controls have periodically shut down one or both of the circuits 22 and 23 when there was a reduced load. Under such conditions, if the number of shutdowns become too excessive, then oil on each subsequent start-up may almost completely leave the compressor 24 being carried out by refrigerant and may not be returned back to the compressor 24. If the compressor is starved of oil, then subsequent damage is likely as moving parts inside the compressor are not being lubricated. Especially when there are excessive shutdowns of one or both of the circuits 22 and 23, the oil may be completely pumped out of the compressor 24 and not returned back to the compressor, and starve compressor 24 of oil. This oil may settle and remain in the heat exchangers (particularly in the evaporator) and connecting lines.

A first aspect of this invention is directed to solving this problem. In the flowchart shown in FIG. 2, the first step is to define an excessive number of compressor shutdowns. If the numbers of shutdowns sensed by the control unit 20 exceeds this number, then a decision is made to no longer shut down one or both of the compressors, but instead to lower the capacity of one of the circuits. The compressors are shut down when there is too much capacity, or all of the available cooling capacity is not necessary. Thus, by reducing the capacity of one of the circuits, the need to start/stop the compressor is eliminated. As one example, the circuit 22 may have its economizer valve 32 shut such that it is no longer operating in economizer mode. This lowers the capacity of the combined system provided by circuits 22 and 23, and alleviates the need to shut down either of the circuits. If this initial reduction in capacity is not sufficient, and excess capacity still exists, then the other circuit 23 may also be moved to non-economized mode. If the shutdowns are still too excessive, then one of the circuits 22 or 23 may be moved into bypass mode by opening one of the bypass valves 42. Again, if there are still too many shutdowns that would be necessary, then both circuits may be moved into the bypass mode. Simultaneous economized and bypassed mode of operation may offer an additional step of unloading and capacity reduction for each compressor.

If the number of shutdowns that would be appropriate are still excessive, then compressors in one of the circuits 22 or 23 is periodically stopped. However, the control intermittently switches which circuit is being stopped such that it is ensured that both circuits are periodically on-line. Thus, the total number of shutdowns can be spared by two circuits rather than keeping one circuit cycling all the time while keeping the other circuit running continuously. This concept can be extended to three or more circuits.

Figure 3:
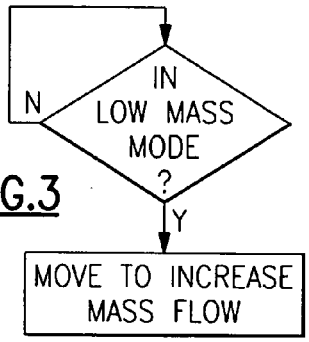
FIG. 3 is a flowchart of a second feature.

As shown in FIG. 3, the other problem of addressing oil return when the system operates at low mass flow rate includes a determination of whether the circuit operates below the lowest acceptable mass flow rate. If it is the case because the circuit is in unloaded mode, or because there is a low suction pressure, then corrective system control actions are taken to alleviate the situation. One way to address this problem is to intermittently run the system at a higher mass rate, or even the highest available mass rate by switching to a more loaded operation. Another way to increase the mass flow rate through the evaporator is by blocking the coils within the condenser 26, reducing the condenser airflow driven by fan 38, increasing the evaporator airflow driven by the evaporator fan 38, or potentially switching off some of the evaporator circuits. Again, the general concept is to increase the mass flow rate through at least some of the evaporator circuits to increase the amount of oil being returned to the compressor. This aspect is illustrated in connection with the two circuit system of FIG. 1, however, it would have benefits in a single circuit system or a system having more than two circuits.

Figure 4:
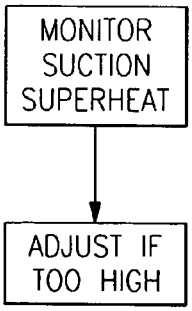
FIG. 4 is a flowchart of a third feature.

FIG. 4 shows a method of monitoring suction superheat or saturation suction temperature. If either of these are identified as being such that the viscosity of the oil is dangerously high to assure appropriate oil return, then the main expansion device 34 is opened by the control unit 20 to reduce the superheat or increase the saturation suction temperature. This aspect can also be utilized in a single circuit system or a system having more than two circuits. As known, for a given refrigerant and oil type, the viscosity of oil-refrigerant mixture in the refrigerant vapor region can be determined based on refrigerant pressure and temperature.

The three distinct inventions of controlling frequent start/stops, low mass flow operation, and high oil viscosity can be utilized in combination, or separately. Subsequently, system reliability and performance are enhanced and compressor damage is prevented.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of operating a refrigerant cycle comprising the steps of:

(1) providing a refrigerant cycle including at least two separately operable refrigerant circuits, and providing a control for operating said circuits, said circuits being capable of operating at various capacities;

(2) determining a load on said cycle, and determining whether one or both of said at least two circuits should be shut down based upon said load and shutting down said circuit, as determined;

(3) monitoring the number of shutdowns of said circuits, and comparing said monitored number to a predetermined maximum; and (4) moving at least one of said circuits to a lower capacity mode if said monitored number of shutdowns exceeds said predetermined value.

2. A method as set forth in claim 1, wherein said circuits are provided with an economizer cycle, and step 4 includes turning off economized operations for at least one of said circuits.

3. A method as set forth in claim 1, wherein said circuits include an unloader circuit, and step 4 includes operating at least one of said circuits in an unloaded mode of operation.

4. A method as set forth in claim 1, wherein if said monitored number still exceeds said predetermined number after step 4, then shutting down one of said circuits, but shutting down different ones of said at least two circuits over time.

5. A method as set forth in claim 1, including the steps of determining whether said refrigerant cycle flow is low and taking control steps to increase a mass flow through said circuit if said determination results in a finding that said refrigerant cycle is in a low mass flow mode.

6. A method as set forth in claim 1, including the steps of monitoring a condition on a suction line leading from an evaporator back to said compressor and changing said monitored condition should said monitored condition indicate a potential problem with returning oil back to said compressor from other points within said circuits.

7. A method of operating a refrigerant cycle comprising the steps of:

(1) providing a refrigerant cycle including at least two separately operable refrigerant circuits, and providing a control for operating said circuits, said circuits being capable of operating at various capacities;

(2) determining a load on said cycle, and determining whether one or both of said at least two circuits should be shutdown based upon said load and shutting down said circuits, as determined;

(3) monitoring the number of shutdowns of said circuits, and comparing said monitored number to a predetermined value;

(4) moving at least one of said circuits to a lower capacity mode if said monitored number of shutdowns exceeds said predetermined value;

(5) determining whether said refrigerant cycle is in a low mass flow mode, and taking control steps to increase a mass flow through said circuit if said determination results in a finding that said refrigerant cycle is in a low mass flow mode; and (6) monitoring a condition on a suction line leading from an evaporator back to a compressor, and changing said monitored condition should said monitored condition indicate a potential problem with returning oil back to said compressor from other points within said circuit.

8. A method as set forth in claim 7, wherein said circuits are provided with an economizer cycle, and step 4 includes turning off economized operations for at least one of said circuits.

9. A method as set forth in claim 7, wherein said circuits include an unloader circuit, and step 4 includes operating at least one of said circuits in an unloaded mode of operation.

10. A method as set forth in claim 7, wherein the mass flow of refrigerant is periodically increased to ensure oil return to said compressor in step 5.

11. A method as set forth in claim 7, wherein the said monitored condition is the suction superheat, and an expansion valve for controlling the suction superheat is based upon said monitored suction superheat.

* * * * *